United States Patent [19]

Wilkinson

[11] 4,340,218

[45] Jul. 20, 1982

[54] RESILIENT TYPE EXERCISER FOR SIMULATING CLIMBING

[76] Inventor: William T. Wilkinson, P.O. Box 3567, Greenville, Del. 19807

[21] Appl. No.: 235,419

[22] Filed: Feb. 17, 1981

[51] Int. Cl.[3] ..... A63B 21/04

[52] U.S. Cl. ..... 272/136; 272/142; 272/DIG. 4; 272/70

[58] Field of Search ..... 272/136, 138, 142, 135, 272/134, 70, 119, 94, 96, 97; 128/25 B, 25 R

[56] References Cited

U.S. PATENT DOCUMENTS 3,659,846 5/1972 Kanicki ..... 272/136

3,677,543 7/1972 Richardson ..... 272/136

3,970,302 7/1976 McFee ..... 272/70

FOREIGN PATENT DOCUMENTS 9862 of 1898 United Kingdom ..... 272/142

*Primary Examiner*—Richard C. Pinkham

*Assistant Examiner*—William R. Browne

*Attorney, Agent, or Firm*—Connolly and Hutz

[57] ABSTRACT

An exercising device for simulating climbing includes a base with a resisting device secured thereto for attachment to the legs of the user and a vertically adjustable step on the base on which the user would step up and down in opposition to the resisting device.

18 Claims, 4 Drawing Figures

RESILIENT TYPE EXERCISER FOR SIMULATING CLIMBING

BACKGROUND OF INVENTION

The present trend of health awareness has led to increased exercising particularly in walking, jogging, running and bicycling. Climbing, however, is a superior exercise in many ways. In this respect, the lifting action that occurs during climbing results in superior development of thigh, hip and buttock muscles. An obvious disadvantage with climbing as an exercise is that climbing facilities are not readily available. It would, therefore, be desirable is some means could be achieved for simulating the climbing action which could be readily available not only for exercise buffs, but also for rehabilitation purposes. It would also be desirable if such simulated climbing could be achieved indoors.

SUMMARY OF INVENTION

An object of this invention is to provide an exercising device which simulates climbing.

A further object of this invention is to provide such a device which could be used indoors.

A still further object of this invention is to provide a device which can be adapted to provide maximum results for the individual user including use for rehabilitation of disabled hospital patients.

In accordance with this invention, the exercising device includes a base on which is mounted resisting means such as spring members which may be attached to the legs of the user. A vertically adjustable step is provided also on the base so that the user may climb up and down the step.

In a preferred form of this invention, an adjustable rail is attached to the step which the user may grasp with his hands to further simulate the climbing action. The rail may be adjustable both vertically and horizontally to move close to or further from the user. Advantageously the resisting means include padded cuffs having suitable attaching means such as velcro for attachment to the user's legs.

THE DRAWINGS

DETAILED DESCRIPTION

Figure 2:
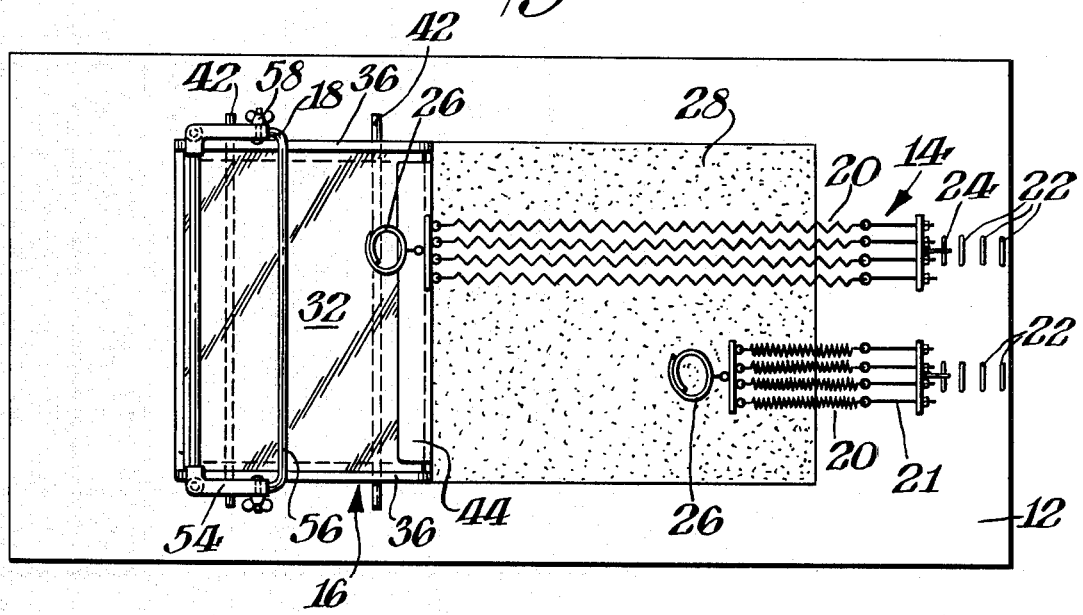
FIG. 2 is a top plan view of the exercising device shown in FIG. 1.
Figure 1:
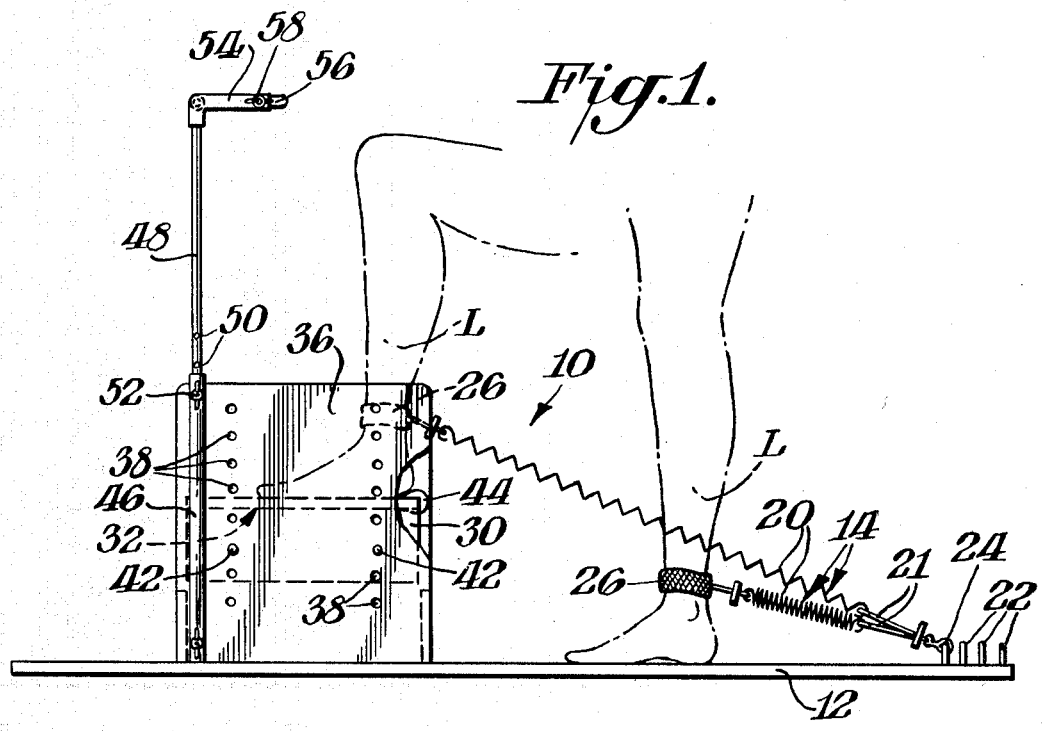
FIG. 1 is a front elevation view of an exercising device in accordance with this invention.
Figure 3:
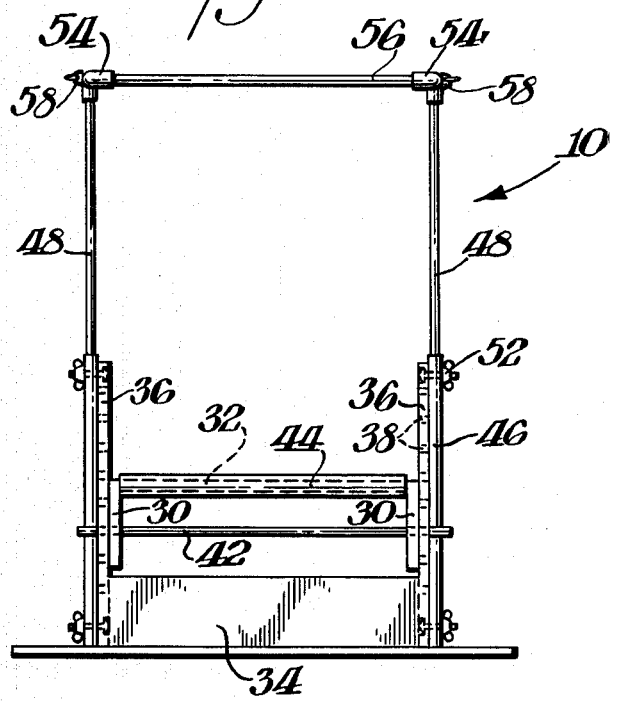
FIG. 3 is a front elevation view of the device as shown in FIGS. 1–2.

As shown in the drawings, the exercising device 10 includes a base member 12 on which is mounted resisting means 14 for attachment to each leg L of the user. An adjustable step 16 is also provided on base member 12 so that the user may step up and down step 16 in opposition to resisting means 14 thereby simulating climbing action while developing muscles in the same manner as would result from actual climbing.

Step 16 is made vertically adjustable so that the user can select the proper height in accordance with his body proportions. The ability to select the proper height is particularly important because if step 16 is made too high, excessive knee pressure would result in producing strain. Conversely, if step 16 is made too low, the knee bend would be insufficient to produce adequate exercise. Step 16 also includes railing 18, as later described, to provide the user with a means for maintaining balance.

Resisting means 14 is preferably formed by a pair of adjustable springs 20, 20. Springs 20, 20 are adjustable in the sense of providing progressive resistance for increased exercise. Such adjustment may be achieved by replacing a set of springs with a different set providing a different degree of resistance, by adjusting the tension in the springs or by varying the location at which springs 20, 20 are mounted so as to vary the amount of force necessary to extend the springs as the user lifts his legs on the step 16. To adjust the tension bolts 21 which connect each spring 20 to an anchor member 22 are manipulated to vary the distance between the springs and the anchor member. Varying the location of springs 20, 20 is accomplished through the use of a plurality of sets of anchor members 22 secured to base 12. Anchor members 22 may be in the form of loops so that springs 20, 20 may be detachably secured thereto by hooks 24 secured to the bar to which blots 21 are mounted or other suitable attaching means. The selection of a particular set of anchor members 22, 22 not only controls the distance over which springs 20, 20 must be stretched, but also the angle of the tension load. Springs 20, 20 may take any suitable form. A convenient and economical spring, for example, would be the type of springs conventionally used on "spring doors". Attached to the end of each spring 20, 20 opposite hooks 24 is a padded cuff or collar 26 which is secured to the legs L of the user in the area of the ankle. Collars 26, 26 may be secured in any suitable manner. It is preferable, however, to use Velcro which offers proper adjustability with maximum comfort as compared, for example, to laces or buckles. Collars 26 may be padded by being made of any suitable material such as styrafoam.

Base member 12 is preferably rectangular for providing step stability and a means for attaching the resistance springs. Base 12 may be made of any suitable material such as wood and preferably includes a slip resistant section 28 which is particularly desirable for the back foot of the user.

Step 16 may be made in any suitable form which provides for vertical adjustability. As illustrated, for example, step 16 includes a pair of side walls 30, 30 spanned by a platform or top wall 32 to form an inverted U. Permanently secured to base member 12 in turn is a support member 34 having upstanding side walls 36, 36. Each side wall 36, 36 includes pairs of aligned holes 38, 38 in alignment with corresponding holes of the other side wall 36. Similarly, each downwardly extending side wall 30, 30 includes a single pair of holes 40, 40 which may be aligned with corresponding holes 38, 38. Holes 38, 40 are of a size to receive rods 42, 42 extending therethrough. Thus, the distance that platform 32 extends above base 12 may be selected by aligning holes 40, 40 with corresponding holes 38, 38 and that distance may be fixed by then inserting rods 42, 42 through the respective sets of aligned holes.

Although the vertical adjustment has been particularly described with respect to aligned holes and rods, other adjusting means may be used such as individual threaded members instead of rods 42 or suitable rack and pinion arrangements so that a turning of a crank would effect the vertical adjustment.

The lead edge of platform 32 is padded as indicated by the reference numeral 44 to prevent knee injury should the user's knee strike the lead edge.

Step 16 also includes an adjustable railing 18. Railing 18 may be formed in any suitable manner. In the illustrated embodiment, railing 18 is both vertically and horizontally adjustable by the use of telescopic members. Specifically, a pair of parallel tubes 46, 46 are secured to outer walls 36, 36 along the remote edge thereof. Rods 48, 48 are telescopically received in each tube 46, 46 and are locked in vertical position in any suitable manner such as by aligned holes 50 and fasteners 52 to provide the vertical adjustability. The upper end of rods 48 are permanently mounted to L-shaped tubes 54, 54. U-shaped rail member 56 in turn has its legs telescoped into tubes 48. The horizontal positioning of rail 56 in tubes 54, 54 may likewise be adjusted in any suitable manner including by means of aligned holes and fasteners. FIG. 2, for example, illustrates the use of bolts and wing nuts 58 to achieve such securement.

Figure 4:
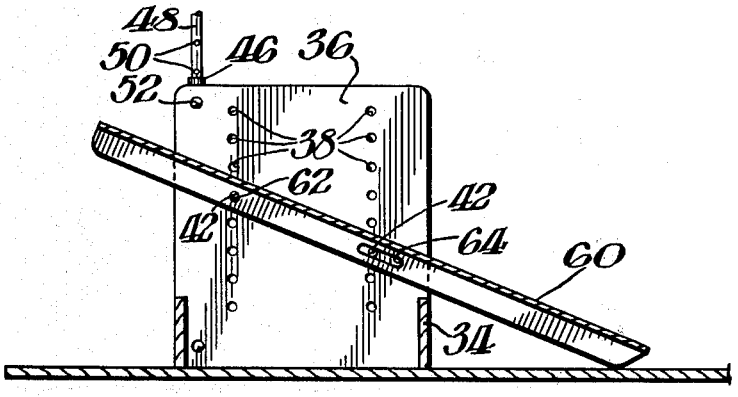
FIG. 4 is a side view of a further ramification of this invention.

The invention may be practiced with step 16 taking various forms. For example, not only is step 16 vertically adjustable, but also the step may take the form of an inclined platform. In this respect, as shown in FIG. 4, a platform 60 is provided preferably channel shaped with downwardly extending flanges having a first hole 62 and a slot 64 to be aligned with holes 38 so that rods 42 may be inserted therethrough similar to the type of adjustment of platform 32. The provision of slot 64 permits angular adjustability. Platform 60 may be mounted directly on platform 32, or as indicated in FIG. 4, platform 32 would be completely detached and platform 60 may then be mounted to the step arrangement by first inserting a rod 42 through an appropriate hole 38, platform hole 62 and corresponding hole 38. Next the proper angle of platform 60 would be selected and a rod 42 would be inserted through lower holes 38, 38 and slot 64.

In use as a flat step, device 10 would be operated as follows. The user would first adjust the height of platform 32 as previously indicated. The user would then adjust the angle and positioning of springs 20, 20 and would select the proper spring tension. Railing 18 would also be adjusted for the particular user's body proportions. The user would then fasten collars 26, 26 to his ankles so that device 10 is ready to be used. In use railing 18 would be grasped for proper balance. The user would climb upon step 16, one foot at a time, and then back down, one foot at a time and repeat the process until the desired exercise is achieved.

As can be appreciated, device 10 provides an exercising device which is capable of being used by people of all ages and which provides a convenient and vigorous way to simulate climbing. Such device can be used as an athletic exerciser for sprinters by providing a high leg lift under resistance using leg lifting power necessary for speed. Such device may also be used simply as an exercising device for building strength and endurance or may be used for the rehabilitation of disabled persons and hospital patients. The simulation of climbing is superior to walking, jogging, running or bicycling for the following reasons.

As compared to walking, climbing is more convenient because the use of device 10 permits the simulated climbing to be done regardless of weather and eliminates the need for special tracks or courses. Simulated climbing is also more comfortable because the use of device 10 indoors avoids exposure of the elements. Climbing against the force of a load is more vigorous thus requiring less time to achieve the desired level of exercise. Simulated climbing is also safer when done indoors. Simulated climbing which is done in place permits the dual use of time such as radio listening or television watching while exercising. Additionally, the resistance climbing with device 10 is more vigorous and achieves better muscle development and also produces superior heart and lung development to provide a cardiovascular exercise.

Simulated climbing is also superior or at least equal to jogging or running for the same general reasons indicated above and is superior for the further reasons that by being done indoors, simulated climbing is done under conditions of controlled temperature, humidity and exposure. This reduces the possibility of overexertion. Additionally simulated climbing does not produce shock and wear on the feet, shins, back, etc.

Simulated climbing is superior to bicycling for much the same reasons and further because bicycling mainly utilizes a downward thrust, while climbing utilizes an upward thrust.

What is claimed is:

1. An exercising device for simulating the action of climbing comprising a base, resisting means secured to said base having means for attachment to the legs of the user to provide a force resisting movement of the user away from said resisting means, a step on said base spaced generally within a normal stride distance from said resisting means so as to receive the foot of a user during an action against said resistance means, said step including an upper platform and downwardly depending side walls, and vertical adjusting means cooperating with said side walls for vertically adjusting the height of said platform above said base.

2. The device of claim 1 including a support member mounted to said base, said support member having a pair of parallel upstanding side walls for cooperating with positioning means on said platform side walls, securing means cooperating with said positioning means for securing said platform side walls to said upstanding side walls after said platform has been mounted in its predetermined position, and said vertical adjusting means comprising said positioning means and said securing means.

3. The device of claim 2 wherein said positioning means includes a plurality of sets of holes in said upstanding side walls and a pair of holes in said platform side walls, and said securing means comprising detachable fasteners for insertion into said holes when said platform side wall holes are aligned with corresponding holes in said upstanding side walls.

4. The device of claim 3 wherein said platform is horizontally mounted with respect to said upstanding side walls.

5. The device of claim 4 wherein the leading edge of said platform is padded.

6. The device of claim 3 wherein said platform is mounted in an inclined position with respect to said upstanding side walls.

7. The device of claim 1 including rail means disposed above said step whereby the user may grasp said rail means.

8. The device of claim 7 wherein said rail means is vertically and horizontally adjustable.

9. The device of claim 8 wherein said rail means includes a pair of vertically mounted tubes secured to said base, a vertical rod telescopically received in each of said vertical tubes, a horizontal tube secured at the upper end of each of said vertical rods, a U-shaped rail having its free ends telescopically received in said horizontal tubes, and fastening means for locking said vertical tubes and said rail in place after adjustment thereof.

10. The device of claim 1 wherein said resisting means comprises a pair of spaced springs, each of said springs being secured at one end to said base and having attachment means at its other end for attachment to the ankles of the user.

11. The device of claim 10 including adjustable anchoring means to vary the location and angle of said springs.

12. The device of claim 11 wherein said attachment means includes a collar, and detachable securing means on said collar for attachment to the user's ankles.

13. The device of claim 12 wherein each of said collars is padded, and said detachable securing means comprises Velcro.

14. The device of claim 3 including rail means disposed above said step whereby the user may grasp said rail means, said rail means being vertically and horizontally adjustable, said resisting means comprising a pair of spaced springs, each of said springs being secured at one end to said base and having attachment means at its other end for attachment to the ankles of the user, adjustable anchoring means varying the location and angle of said springs, and said attachment means including a collar and detachable securing means on said collar for attachment to the user's ankle.

15. A method of simulating climbing comprising the steps of vertically adjusting a platform a selected distance above a base, securing the platform in position, mounting resilient resistance means to the base, attaching the resistance means to the ankles of the user, stepping up on to the platform one foot at a time in opposition to the force of the resilient resistance means, stepping down from the platform one foot at a time, and repeating the stepping up and stepping down.

16. The method of claim 15 including horizontally and vertically adjusting the position of a rail secured to the base above the step.

17. The method of claim 16 wherein the step of securing the platform in position includes securing the platform in a horizontal position parallel to the base.

18. The method of claim 16 wherein the step of securing the platform in position includes securing the platform in an inclined position at an angle to the base.

* * * * *